US006865875B2

(12) United States Patent
Watkins

(10) Patent No.: US 6,865,875 B2
(45) Date of Patent: Mar. 15, 2005

(54) REPLACEABLE COMPONENTS FOR A FLYER BOW

(75) Inventor: David K. Watkins, Pisgah Forest, NC (US)

(73) Assignee: Keir Manufacturing Inc., Brevard, NC (US)

( * ) Notice: Subject to any disclaimer, the term of this patent is extended or adjusted under 35 U.S.C. 154(b) by 0 days.

(21) Appl. No.: 10/379,704

(22) Filed: Mar. 6, 2003

(65) Prior Publication Data

US 2004/0172932 A1 Sep. 9, 2004

(51) Int. Cl.[7] ..... D01H 7/26
(52) U.S. Cl. ..... 57/115; 57/58.63; 57/67
(58) Field of Search ..... 57/58.63, 67, 115, 57/116, 117, 118

(56) References Cited

U.S. PATENT DOCUMENTS

| | | | | |
|---|---|---|---|---|
| 1,371,261 A | | 3/1921 | Price | |
| 3,793,819 A | | 2/1974 | Madalozzo et al. | |
| 4,256,268 A | | 3/1981 | Fahrbach | |
| 5,509,260 A | * | 4/1996 | Derdeyn | 57/58.83 |
| 5,671,878 A | | 9/1997 | Kawasaki | |
| 5,809,763 A | | 9/1998 | Rowlands et al. | |
| 6,289,661 B1 | | 9/2001 | Boland | |
| 2002/0112462 A1 | * | 8/2002 | Bock | 57/404 |

FOREIGN PATENT DOCUMENTS

| | | | | |
|---|---|---|---|---|
| JP | 05247861 A | * | 9/1993 | D07B/3/08 |
| JP | 06346388 A | * | 12/1994 | D07B/3/10 |

OTHER PUBLICATIONS

Miscellaneous Commercial Literature, 3 pages, dates unknown.

Brochure, Kamatics—Flyer Bow—Line Card, Kamatics Corporation, 2 pages, date unknown.

Commerical Literature, Kamatics—Clamp on Guide System, Kamatics Corporation, 1 page, date unknown.

Commercial Literature, Kamatics—Composite Flyer Bows, Kamatics Corporation, 2 pages, date unknown.

* cited by examiner

*Primary Examiner*—John J. Calvert
*Assistant Examiner*—Shaun R Hurley
(74) *Attorney, Agent, or Firm*—Finnegan, Henderson, Farabow, Garrett & Dunner, LLP

(57) ABSTRACT

Apparatus used in connection with a flyer bow. The bow has a longitudinal recess, at least one wear insert in the recess, at least one guide in the recess, and a stop to keep the wear inserts and guides in the recess. The recess has an inner transverse dimension that is larger than an outer transverse dimension. The wear inserts and guides have a engagement portions that fit within the recess and restrain them from significant radial movement. A stop, detachably affixed to the flyer bow, restrains them from longitudinal movement.

21 Claims, 5 Drawing Sheets

REPLACEABLE COMPONENTS FOR A FLYER BOW

FIELD OF THE INVENTION

This invention relates generally to replaceable components that are detachable mounted on the flyer bows of a group of machinery used for cabling referred to as twisting, bunching, cabling, twinning, or stranding machines.

BACKGROUND

Twisting machines, and more particularly bow twisting machines, are commonly employed to manufacture twisted wire or cables such as standard telephone twisted-pair wire. These machines wrap at least one wire around a core made up of one or more cables or conductors. Typical construction and operation of such machines use one or more bows. A bow is a part of the machine that guides the wire along the length of the bow as the bow rotates around the central portion of the bow-twisting machine. This rotation wraps the initially straight wire into a bunched configuration.

Bows for use on twisting machines are well known in the art. Prior art bows for bow-twisting machines (commonly referred to as "flyer bows") are typically flat and have wire guides and/or wear strips, mounted on their inner surface. The wire guides position the wire to be twisted by the bow-twister machine and the wear strips serve to protect the bow from damage due to contact between the wire/cable and the bow during operation of the bow-twister machine. The bow is periodically removed from the bow-twister machine to replace worn or damaged parts or components. Numerous problems exist, however, with the mounting of components on prior bows.

One prior technique of mounting these components on bows is described in U.S. Pat. No. 5,809,763 ("the '763 patent"). The '763 patent mounts components to the bow using connectors such as bolts or rivets. Another prior technique is described in U.S. Pat. No. 6,289,661 ("the '661 patent"). The '661 patent employs a clamping system that involves splitting the components into two pieces. The pieces are assembled around the bow's cross-section and reattached to each other through the use of bolts, rivets or other suitable connection means.

A disadvantage of such apparatus is that numerous fasteners such as nuts, bolts or rivets are required to attach the components to the bow. This makes replacement of the components cumbersome and labor-intensive, as each bolt or rivet must be removed in order to remove the worn or damaged component from the bow. Another disadvantage is that, for the clamping system components, each side of the clamp must be separated by removing individual bolts and/or rivets, which makes replacing components labor and time intensive.

Another disadvantage of using such prior techniques is that fasteners occasionally break or come loose, resulting in an unsafe and dangerous situation. If the fasteners fail, or worse if multiple fasteners fail simultaneously, the fasteners and larger parts of the rotating machinery are thrown from the machinery at dangerous velocities. Another disadvantage is that the fasteners add weight to the bow assembly requiring greater horsepower to operate. Further, the fasteners may create wind resistance as the bow spins creating draw and increasing the horsepower needed to operate.

Thus, what is needed is an apparatus that attaches guides and wear strips to the bows with fewer fasteners. This reduces the labor and time involved in replacing these components when they need replacement, reduces the danger inherent with their breakage and increases the efficiency of the bow moving through the air.

SUMMARY

To achieve the advantages of the invention, and in accordance with the purpose of the invention, as embodied and broadly described herein, the invention comprises the following.

According to one aspect of the invention, there is an apparatus that is comprised of an elongated flyer bow having an inner and outer surface. One of these surfaces has at least one longitudinal recess extending within the surface. At least one of the recesses has an inner transverse dimension and an outer transverse dimension. The inner transverse dimension of the recess is greater than said outer transverse dimension. The apparatus further includes at least one wear component having a bow engagement portion disposed to slidably engage the longitudinal recess in the flyer bow. The wear component has a wear surface opposite the engagement portion, and engagement of that portion with the longitudinal recess in the flyer bow restrains significant radial movement of the wear component. The apparatus further includes at least one guide having a bow engagement portion disposed to slidably engage the longitudinal recess in the flyer bow. The guide includes a guide opening opposite the bow engagement portion of the guide. Engagement of the engagement portion of the guide with the longitudinal recess in the flyer bow restrains significant radial movement of the guide. The apparatus further includes at least one stop detachably affixed to the flyer bow such that the wear components and guides in the longitudinal recess are longitudinally confined therein.

Another aspect of the invention is a wear insert for a flyer bow having a longitudinal recess. The wear insert has a bow engagement portion disposed to slidably engage the longitudinal recess. The bow engagement portion has an inner transverse dimension and an outer transverse dimension, with the inner transverse dimension being greater than the outer transverse direction. The wear insert has a wear surface opposite the engagement portion.

Another aspect of the invention is guide for a flyer bow having a longitudinal recess. The guide has a bow engagement portion disposed to slidably engage the longitudinal recess in the flyer bow. The bow engagement portion has an inner transverse dimension and an outer transverse dimension, with the inner transverse dimension being greater than the outer transverse direction. The guide has a guide opening opposite the engagement portion.

The apparatus described above provides replaceable components of a flyer bow that are readily replaced, that are securely restrained without fasteners that can come off the flyer bow at dangerous velocities and can be readily manufactured from wear-resistant materials.

Further objects, features and advantages of the present invention will become apparent upon review of the following detailed description of the preferred embodiments of the invention, taking into consideration the drawings and ensuing description. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accompanying drawings illustrate several preferred embodiments and, together with the description, serve to explain the principles of the invention. In the drawings.

DETAILED DESCRIPTION OF THE PREFERRED EMBODIMENTS

Reference will now be made to several preferred embodiments of the invention, examples of which are illustrated in the accompanying drawings. Wherever possible, the same reference numbers are used throughout the drawings to refer to the same or like parts.

In accordance with one aspect of the invention, there is provided an apparatus having an elongated flyer bow with an inner and outer surface, one of said surfaces having at least one longitudinal recess extending within said that surface. The flyer bow can be made of any material known to those skilled in the art to be operable as a flyer bow. Typically, flyer bows are metals, or fiber reinforced composites having either a metal or polymer matrix. The material used for the flyer bow of the present invention should have sufficient mechanical properties to restrain components within the longitudinal recess from moving in a radial direction as the invention is designed to operate without the fasteners that conventional flyer bows use to restrain components mounted thereon from moving in the radial direction.

Figure 1:
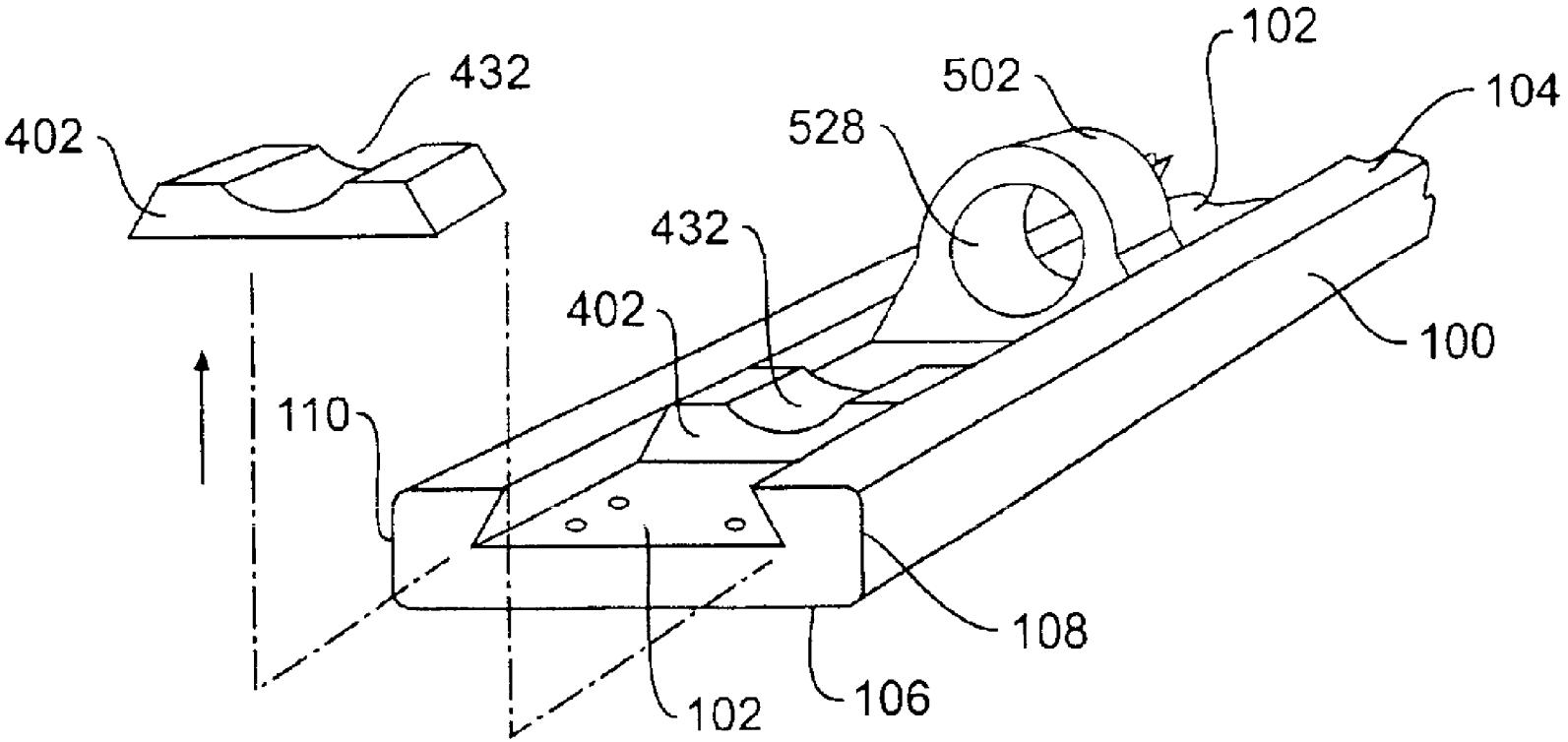
FIG. 1 is a perspective view of one embodiment of a flyer bow, guide, wear insert, and stop in an partially assembled configuration.
Figure 2:
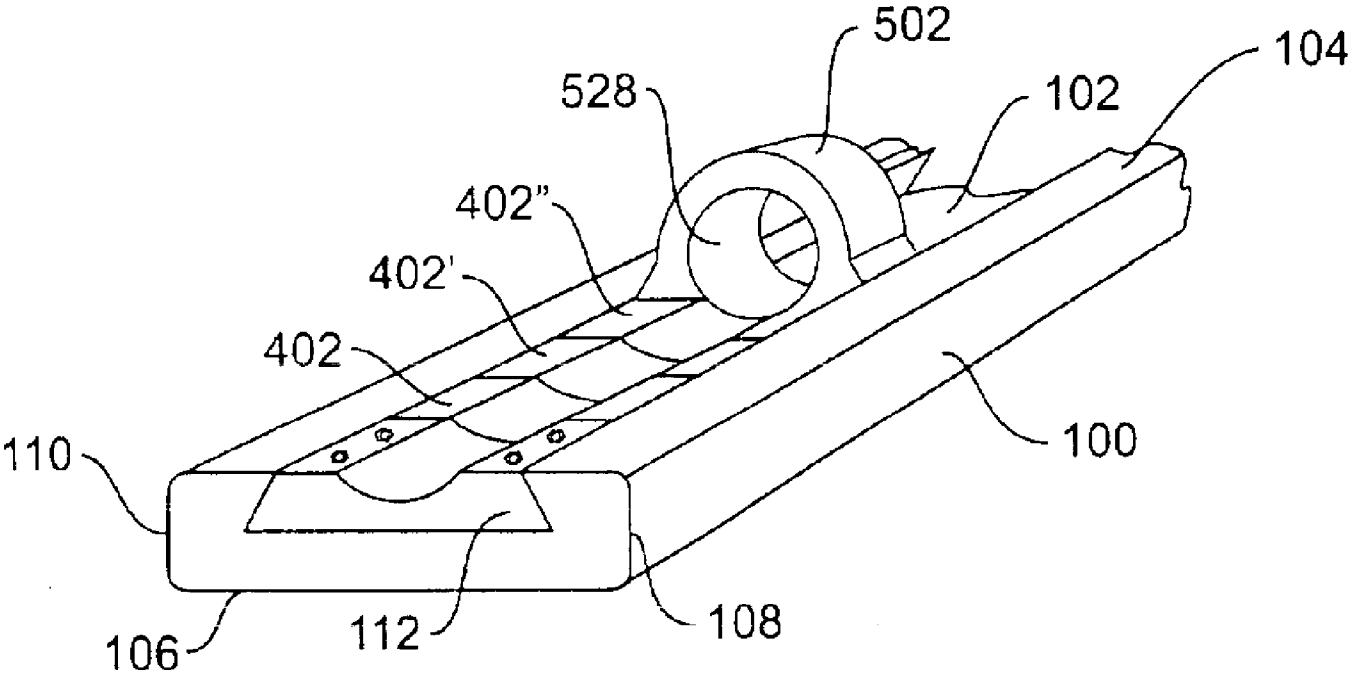
FIG. 2 is a perspective view of the embodiment of FIG. 1 shown in an fully assembled configuration.
Figure 3A:
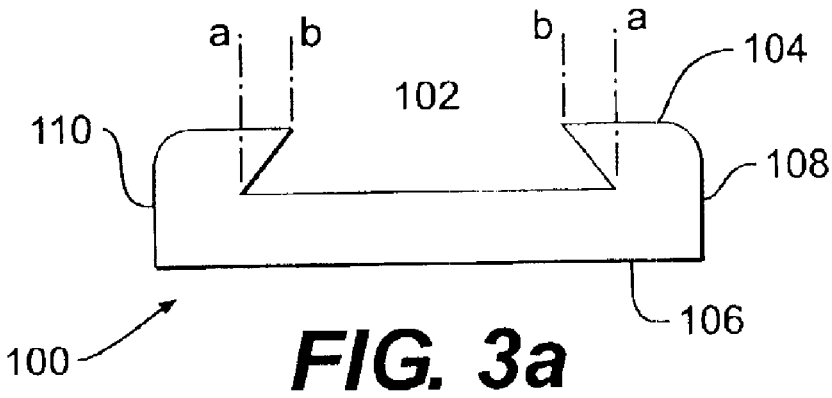
FIG. 3*a* is a cross-sectional view of the bow embodiment shown in FIG. 1 having a longitudinal recess with a "dove-tail" cross-sectional shape.

As here embodied, and most clearly depicted in FIGS. 1, 2, and 3*a*, the flyer bow 100 has a longitudinal recess 102 extending along its length. In this embodiment the longitudinal recess is in the top surface 104 of the flyer bow 100, however, the configuration of the flyer bow and the components affixed therein could be reversed, and the longitudinal recess could be on the bottom surface 106 of the flyer bow 100. Stated another way, the assembly shown in FIG. 2 could be inverted.

In this disclosure, the direction along the length of the flyer bow is the "longitudinal direction," the "transverse direction" is the direction across the width of the flyer bow from one edge to the opposite edge. As here embodied, and shown in FIGS. 1 and 2 the "transverse direction" is from edge 108 to edge 110. The "radial direction" is perpendicular to the upper surface of the flyer bow as depicted by the arrow in FIG. 1.

Figure 3B:
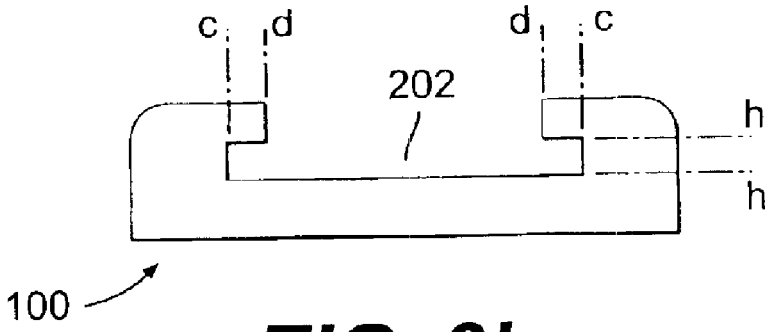
FIG. 3*b* is a cross-sectional view of another embodiment of a flyer bow having a longitudinal recess with a "T"-type cross-sectional shape.

In accordance with this aspect of the invention, the flyer bow has a longitudinal recess with at least one recess with an inner transverse dimension and an outer transverse dimension, the inner transverse dimension being greater than the outer transverse dimension. As here embodied, and shown in FIG. 3*a*, the longitudinal recess 102 has an inner transverse dimension a—a that is greater than the outer transverse dimension b—b. Similarly, in the embodiment of FIG. 3*b* the longitudinal recess 202 has an inner transverse dimension c—c that is greater than the outer transverse dimension d—d. As disclosed above, the longitudinal recess restrains components placed therein from moving in the radial direction, and its is the mismatch between the inner and outer transverse dimensions of the longitudinal recess or recesses that provide the radial restraint. In the embodiment depicted in FIG. 3*c*, the longitudinal recess 302 is a compound recess and has therein two smaller longitudinal recesses, 304 and 306. These two "dove-tail" recesses each have an inner transverse dimension that is greater than the outer transverse dimension, shown in FIG. 3*c* as inner transverse dimension e—e that is greater than the outer transverse dimension f—f. Thus, in the embodiment of FIG. 3*c*, the sides of the longitudinal recesses 310, 312, 314, and 316 all provide restraint in the radial direction to components having a complimentary shape placed within the compound longitudinal recess 302.

Although it is feasible to have the longitudinal recess have a cross sectional shape that varies along its length, that would require components having portions fitting therein to either not fit the recess exactly or have such components have portions that engage the recess have different shapes to fit at particular locations along the length of the flyer bow. While such an embodiment is operable, and would provide some longitudinal restraint to such components, the difficulty in matching the correct sized component with the proper location along the flyer bow with a non-uniform longitudinal recess would not be advantageous. For that reason, it is preferred that the longitudinal recess has a uniform cross-sectional shape in the longitudinal direction.

Figure 4A:
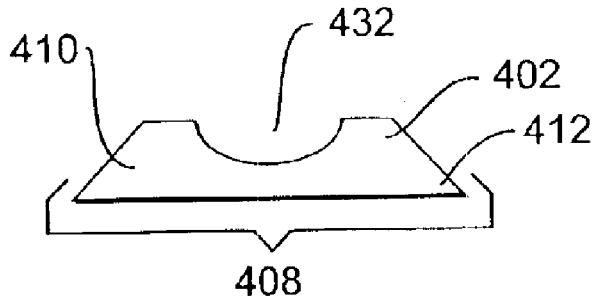
FIG. 4*a* is a cross-sectional view of the wear insert embodiment shown in FIG. 1 having an engagement portion disposed to fit within the "dove-tail" longitudinal recess of the flyer bow shown in FIGS. 1, 2, and 3*a;*

In accordance with this aspect of the invention, there is at least one wear insert having a bow engagement portion disposed to slidably engage the longitudinal recess in the flyer bow, engagement with the longitudinal recess restraining significant radial movement of the wear insert within the longitudinal recess. As here embodied, and depicted in FIGS. 4*a–c*, there are wear inserts 402, 404, and 406. In the embodiment of FIG. 4*a*, the wear insert 402 includes an engagement portion 408 comprised of the base of the wear insert having opposed triangular projections 410 and 412 that are disposed to fit within the complimentary longitudinal recess 102 depicted in the flyer bow 100 of FIGS. 1, 2, and 3*a*. In this embodiment, the width of the engagement portion 408 of wear insert 402 is substantially the same as the transverse dimension a—a in the longitudinal recess 102. In addition, in this embodiment the angles of the base 408 match those of the longitudinal recess 102 such that the wear insert can be slid longitudinally into the longitudinal recess 102. Such a relationship is what is referred to herein as "slideably engaged."

The function of the wear insert in this aspect of the invention is to prevent sliding contact of the elongated material being wound by means of the flyer bow with the surface of the flyer bow. In accordance with this aspect of the invention, the wear insert has a wear surface on the face of the wear insert opposite the engagement portion.

As here embodied, the wear inserts 402, 404, and 406 are comprised of a hard, wear-resistant material. The composition of the wear-resistant material is not known to be critical. It must have sufficient fracture toughness to be fabricated into components having some stress raisers, of sufficient strength to withstand the loads applied to it, and be resistant to wear from sliding contact. The wear inserts could also be comprised of different parts, with the portion that engages the flyer bow being strong but not necessarily wear-resistant, with a wear-resistant layer or coating on the portion of the wear insert in sliding contact with the elongated article being wound by the flyer bow. For example, the wear insert could be a metal with a wear-resistant coating, a composite with a wear-resistant metal or ceramic insert bonded or affixed thereto, or a homogeneous, wear-resistant material. Preferably, the wear-resistant material consists essentially of a ceramic material selected from the group consisting of alumina, zirconia, silicon nitride, and tungsten carbide.

Figure 4B:
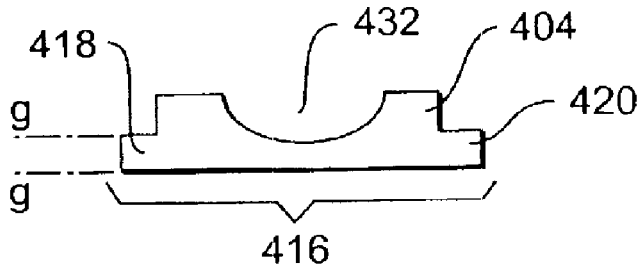
FIG. 4*b* is a cross-sectional view of another wear insert embodiment having an engagement portion disposed to fit within the "T"-type longitudinal recess of the flyer bow shown in FIG. 3*b;*

Another embodiment of a wear inert is depicted in FIG. 4*b*. In such an embodiment, the base 416 of the wear insert 404 includes two opposed rectangular portions, 418 and 420. This embodiment is disposed to slidably engage into the longitudinal recess 202 in the flyer bow 100 of FIG. 3*b*. In this embodiment, the width of the base of 416 of wear insert 404 is substantially the same as the transverse dimension c—c in the longitudinal recess 202. In addition, in this embodiment the height of the base 416 (g—g in FIG. 4*b*) is substantially the same as the height (h—h in FIG. 3*b*) of the "T-shaped" longitudinal recess 202 depicted in FIG. 3*b* such that the wear insert can be slid longitudinally into the longitudinal recess 202 and restrained from radial and transverse movement.

Figure 3C:
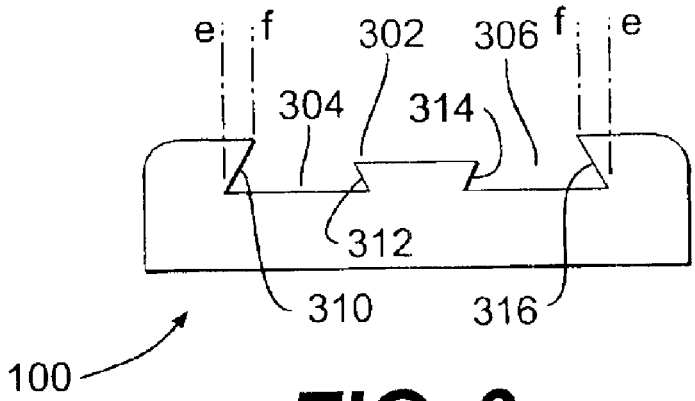
FIG. 3*c* is a cross-sectional view of still another embodiment of a flyer bow having a longitudinal recess with a compound cross-sectional shape of multiple "dove-tail" recesses within the main longitudinal recess.
Figure 4C:
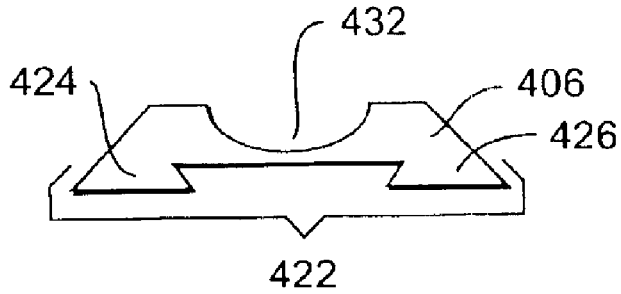
FIG. 4*c* is a cross-sectional view of still another embodiment of a insert having an engagement portion disposed to fit within the compound cross-sectional shape of multiple "dove-tail" recesses within the main longitudinal of the flyer bow of FIG. 3*c;*

Another embodiment of a wear insert is depicted in FIG. 4*c*. In such an embodiment, the base 422 of the wear insert 406 includes two opposed dove-tail portions, 424 and 426. This embodiment is disposed to slidably engage into the longitudinal recess 302 in the flyer bow 100 FIG. 3*c*. In this embodiment, the width of the base of 422 of wear insert 406 is substantially the same as the transverse dimension e—e in the longitudinal recess 302. In addition, in this embodiment the transverse dimensions and heights of the two dove-tail portions 424 and 426 are substantially the same as the configuration of the longitudinal recesses 304 and 306 in the flyer bow 100 of FIG. 3*c* such that the wear insert can be slid longitudinally into the longitudinal recess 302 and restrained from radial and transverse movement. The wear insert of FIG. 4*c* has the advantage that the radial load applied to the wear insert it not borne solely by the outer transverse extremities of the wear insert.

In the embodiments of FIGS. 4*a–c*, the wear inserts 402, 404, and 406 have a wear surface that includes a semi-circular longitudinal groove 432. The shape of that groove, or even its presence is not known to be critical to the operation of the wear insert or the assembly in which it is used.

Figure 5A:
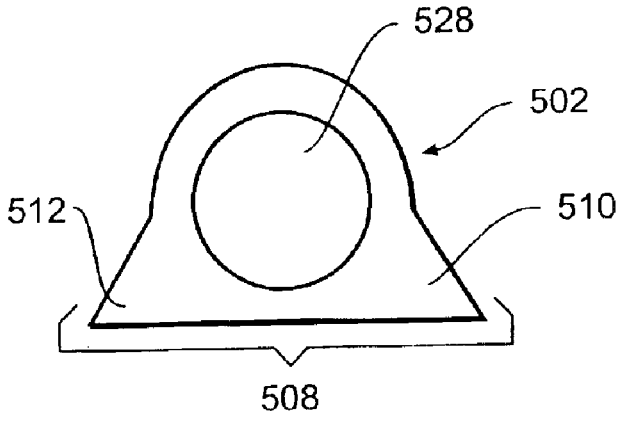
FIG. 5*a* is a cross-sectional view of the guide embodiment shown in FIG. 1 having an engagement portion disposed to fit within the "dove-tail" longitudinal recess of the flyer bow shown in FIGS. 1, 2, and 3*a;*

In accordance with this aspect of the invention, there is at least one guide having a bow engagement portion disposed to slidably engage the longitudinal recess in the flyer bow, engagement with the longitudinal recess restraining significant radial movement of the wear insert within the longitudinal recess. As here embodied, and depicted in FIGS. 5*a–c*, there are guides 502, 504, and 506. In the embodiment of FIG. 5*a*, the guide 502 includes an engagement portion 508 comprised of the base of the wear insert having opposed triangular projections 510 and 512 that are disposed to fit within the complimentary longitudinal recess 102 depicted in the flyer bow 100 of FIGS. 1, 2, and 3*a*. In this embodiment, the width of the base of 508 of guide 502 is substantially the same as the transverse dimension a—a in the longitudinal recess 102. In addition, in this embodiment the angles of the base 508 match those of the longitudinal recess 102 such that the guide can be slid longitudinally into the longitudinal recess 102.

The function of the guide in this aspect of the invention is to confine the elongated material being wound by the flyer bow, and prevent sliding contact of that material with the surface of the flyer bow. In accordance with this aspect of the invention, the guide has an opening in the guide opposite the engagement portion.

As here embodied, the guides 502, 504, and 506 are comprised of a hard, wear-resistant material. The composition of the wear-resistant material is not known to be critical. It must have sufficient fracture toughness to be fabricated into components having relatively thin sections, some stress raisers, of sufficient strength to withstand the loads applied to it, and be resistant to wear from sliding contact. The guides could also be comprised of different parts, with the portion that engages the flyer bow being strong but not necessarily wear-resistant, with a wear-resistant layer or coating on interior of the opening in the guide that is in sliding contact with the elongated article being wound by the flyer bow. For example, the wear insert could be a metal with a wear-resistant coating, a composite with a wear-resistant metal or ceramic insert bonded or affixed thereto, or a homogeneous, wear-resistant material. Preferably, the wear-resistant material consists essentially of a ceramic material selected from the group consisting of alumina, zirconia, silicon nitride, and tungsten carbide.

Figure 5B:
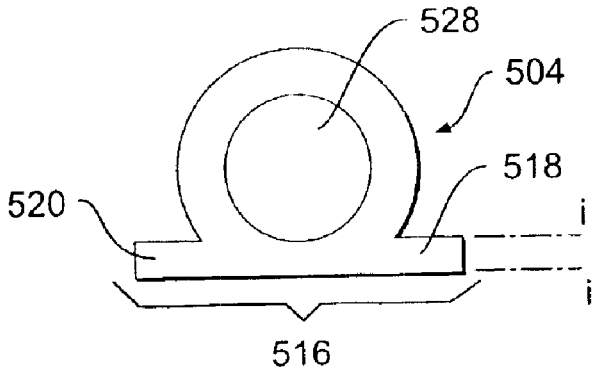
FIG. 5*b* is a cross-sectional view of another guide embodiment having an engagement portion disposed to fit within the "T"-type longitudinal recess of the flyer bow shown in FIG. 3*b*.

Another embodiment of a guide is depicted in FIG. 5*b*. In such an embodiment, the base 516 of the wear insert 504 includes two opposed rectangular portions, 518 and 520. This embodiment is disposed to slidably engage into the longitudinal recess 202 in the flyer bow 100 of FIG. 3*b*. In this embodiment, the width of the base of 516 of wear insert 504 is substantially the same as the transverse dimension c—c in the longitudinal recess 202. In addition, in this embodiment the height of the base 516 (i—i in FIG. 5*b*) is substantially the same as the height (h—h in FIG. 3*b*) of the "T-shaped" longitudinal recess 202 depicted in FIG. 3*b* such that the wear guide can be slid longitudinally into the longitudinal recess 202 and restrained from radial and transverse movement.

Figure 5C:
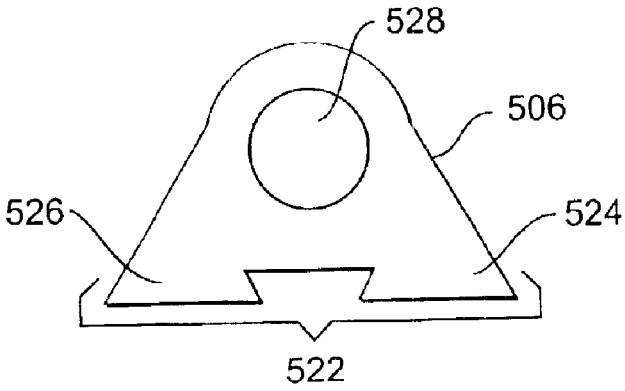
FIG. 5*c* is a cross-sectional view of still another embodiment of a guide having an engagement portion disposed to fit within the compound cross-sectional shape of multiple "dove-tail" recesses within the main longitudinal of the flyer bow of FIG. 3*c*.

Another embodiment of a wear inert is depicted in FIG. 5*c*. In such an embodiment, the base 522 of the wear insert 506 includes two opposed dove-tail portions, 524 and 526.

This embodiment is disposed to slidably engage into the longitudinal recess 302 in the flyer bow 100 of FIG. 3*c*. In this embodiment, the width of the base of 522 of wear insert 506 is substantially the same as the transverse dimension e—e in the longitudinal recess 302. In addition, in this embodiment the transverse dimensions and heights of the two dove-tail portions 524 and 526 are substantially the same as the configuration of the longitudinal recesses 304 and 306 in the flyer bow 100 in FIG. 3*b* such that the guide can be slid longitudinally into the longitudinal recess 302 and restrained from radial and transverse movement. The guide of FIG. 5*c* has the advantage that the radial load applied to the wear insert it not borne solely by the outer transverse extremities of the guide.

In accordance with this aspect of the invention, the guide has a guide opening opposite the engagement portion of the guide. As here embodied, and clearly depicted in FIGS. 5*a–c* the guides 502, 504, and 506 have a guide portion 528 that includes a circular opening 532. The shape of that opening is not known to be critical to the operation of the guide or the assembly in which it is used other than its diameter must be larger than the diameter of the material that is passed through the opening to be guided.

In accordance with this aspect of the invention the apparatus includes at least one stop detachably affixed to the flyer bow such that said wear inserts and guides in said longitudinal recess are longitudinally confined therein. The function of the stop is to prevent longitudinal movement of the components (wear insert and guides) within the longitudinal recess in the flyer bow. As here embodied and depicted in FIG. 2, there is included a stop 112 having a shape similar to the wear insert 402. In this embodiment, the stop 112 contains a plurality of holes for fasteners to affix the stop 112 to the flyer bow 100. In a preferred embodiment of the invention, the base of the stop 112 would have the same cross-sectional shapes as are depicted in FIGS. 4*a–c* for the bases of the wear inserts, depending upon the cross-sectional shape of the longitudinal recess of the bow in which the stop 112 was to be placed.

It is further preferred that the stop include a bow engagement portion disposed to slidably engage the longitudinal recess. The engagement of the stop with the longitudinal recess restrains significant radial movement of the stop when it is placed in the longitudinal recess. Moreover, the fasteners (not shown) would affix the stop 112 to the flyer bow 100 would restrain significant movement of the stop and all components within the longitudinal recess 102 in the longitudinal direction. As here embodied, and depicted in FIG. 2, the stop 112 abuts an adjacent wear insert 402 which in turn abuts a succession of wear inserts 402', 402" and a guide 502. In such a manner the components within the longitudinal recess in the flyer bow are restrained radially and horizontally without the use of an excessive number of fasteners. The wear inserts and guides can be readily replaced without the effort needed to disconnect numerous fasteners. In addition, the elimination of the large number of fasteners reduces the possibility that such fasteners could come loose and be propelled into the facility were the device was in use.

It will be apparent to those skilled in the art that various modifications and variations can be made in the above-described embodiments of the present invention without departing from the scope and spirit of the invention. Thus, it is intended that the present invention include such modifications and variations provided they come within the scope of the appended claims and their equivalents.

What is claimed is:

1. An apparatus, comprising:

an elongated flyer bow having an inner and outer surface, one of said surfaces having at least one longitudinal recess extending within said one surface, said at least one recess having an inner transverse dimension and an outer transverse dimension, said inner transverse dimension being greater than said outer transverse dimension;

at least one wear insert having a bow engagement portion disposed to slidably engage said longitudinal recess, said wear insert having a wear surface on the face of said wear insert opposite said engagement portion, engagement with said longitudinal recess restraining significant radial movement of said wear insert;

at least one guide having a bow engagement portion disposed to slidably engage said longitudinal recess and a guide opening located on the opposite side of said guide from said bow engagement portion, engagement of said bow engagement portion with said longitudinal recess restraining significant radial movement of said guide; and at least one stop detachably affixed to said flyer bow such that said wear inserts and guides in said longitudinal recess are longitudinally confined therein.

2. The apparatus of claim 1, said stop including a bow engagement portion disposed to slidably engage said longitudinal recess, engagement with said longitudinal recess restraining significant radial movement of said stop, said stop being placed in said longitudinal recess.

3. The apparatus of claim 1, said longitudinal recess having a generally uniform cross-sectional shape.

4. The apparatus of claim 1, wherein said longitudinal recess has a cross-sectional shape that is a portion of a triangle.

5. The apparatus of claim 1, wherein said longitudinal recess has a compound cross-sectional shape.

6. The apparatus of claim 5, wherein said compound cross-sectional shape is comprised of several portions of triangles.

7. The apparatus of claim 5, wherein said compound cross-sectional shape is comprised of a plurality of dove-tail-shaped recesses.

8. A wear insert for a flyer bow having a longitudinal recess, said wear insert comprising:

a bow engagement portion disposed to slidably engage said longitudinal recess, said bow engagement portion having an inner transverse dimension and an outer transverse dimension, said inner transverse dimension being greater than said outer transverse direction, said wear insert having a wear surface opposite said engagement portion.

9. The wear insert of claim 8, wherein said recess and said engagement portion have generally uniform cross-sectional shapes.

10. The wear insert of claim 9, wherein said uniform cross-sectional shapes are the same.

11. The wear insert of claim 8, wherein said recess and said engagement portion have a cross-sectional shape that is a portion of a triangle.

12. The wear insert of claim 8, wherein said recess and said engagement portion have a compound cross-sectional shape.

13. The wear insert of claim 12, wherein said compound cross-sectional shape is comprised of several portions of triangles.

14. The wear insert of claim 12, wherein said compound cross-sectional shape is comprised of a plurality of dovetail-shaped recesses.

15. A guide for a flyer bow having a longitudinal recess, said guide comprising:

a bow engagement portion disposed to slidably engage said longitudinal recess, said bow engagement portion having an inner transverse dimension and an outer transverse dimension, said inner transverse dimension being greater than said outer transverse direction, said guide having a guide opening opposite said engagement portion.

16. The guide of claim 15, wherein said recess and said engagement portion have generally uniform cross-sectional shapes.

17. The guide of claim 16, wherein said uniform cross-sectional shapes are the same.

18. The guide of claim 15, wherein said recess and said engagement portion have a cross-sectional shape that is a portion of a triangle.

19. The guide of claim 15, wherein said recess and said engagement portion have a compound cross-sectional shape.

20. The guide of claim 19, wherein said compound cross-sectional shape is comprised of several portions of triangles.

21. The guide of claim 19, wherein said compound cross-sectional shape is comprised of a plurality of dovetail-shaped recesses.

* * * * *

UNITED STATES PATENT AND TRADEMARK OFFICE

CERTIFICATE OF CORRECTION

PATENT NO. : 6,865,875 B2
APPLICATION NO. : 10/379704
DATED : March 15, 2005
INVENTOR(S) : David K. Watkins It is certified that error appears in the above-identified patent and that said Letters Patent is hereby corrected as shown below:

In column 6, line 11, “wear insert” should read --guide--;

In column 6, line 15, “wear insert” should read --guide--;

In column 6, line 43, “wear insert” should read --guide--;

In column 6, line 51, “wear insert” should read --guide--;

In column 6, line 55, “wear insert” should read --guide--;

In column 6, line 61, “wear” should read --wear insert--;

In column 6, line 64, “wear insert” should read --guide--;

In column 6, line 65, “wear insert” should read --guide--;

In column 7, line 3, “wear insert” should read --guide--;

Signed and Sealed this

Second Day of June, 2009

John Doll

JOHN DOLL
*Acting Director of the United States Patent and Trademark Office*